United States Patent [19]

Wilkes

[11] Patent Number: 5,029,915

[45] Date of Patent: Jul. 9, 1991

[54] VEHICLE DOOR LOCKING SYSTEM

[75] Inventor: Steven F. Wilkes, Hadley Heath, Great Britain

[73] Assignee: Rockwell Automotive Body Systems (UK) Ltd., England

[21] Appl. No.: 464,955

[22] Filed: Jan. 16, 1990

[30] Foreign Application Priority Data

Jan. 17, 1989 [GB] United Kingdom ..... 8900960

[51] Int. Cl.[5] ..... E05B 65/36

[52] U.S. Cl. ..... 292/336.3; 70/264; 74/527

[58] Field of Search ..... 292/201, 336.3; 70/264; 74/527

[56] References Cited

U.S. PATENT DOCUMENTS

| | | | |
|---|---|---|---|
| 3,890,813 | 6/1975 | Cothron | 292/210 X |
| 4,518,181 | 5/1985 | Yamada | 292/201 |
| 4,706,512 | 11/1987 | McKernon et al. | 292/336.3 X |
| 4,723,454 | 2/1988 | Periou et al. | 74/89.15 |
| 4,739,677 | 4/1988 | Kofink et al. | 292/336.3 X |
| 4,779,912 | 10/1988 | Ikeda et al. | 292/201 X |

FOREIGN PATENT DOCUMENTS

| | | | |
|---|---|---|---|
| 0164145 | 12/1985 | European Pat. Off. | 70/264 |
| 0213993 | 3/1987 | European Pat. Off. . | |
| 0230808 | 8/1987 | European Pat. Off. . | |
| 2745711 | 4/1979 | Fed. Rep. of Germany | 70/264 |
| 3629556 | 3/1988 | Fed. Rep. of Germany | 70/264 |
| 2118615 | 11/1983 | United Kingdom | 70/264 |
| 2176528 | 12/1986 | United Kingdom . | |

*Primary Examiner*—Lloyd A. Gall

*Attorney, Agent, or Firm*—Learman & McCulloch

[57] ABSTRACT

Power actuated dead-locking unit for a centrally controlled vehicle door locking system has a lock actuating formation (20) which is shifted between locked and unlocked positions by a motor driven rotary operating cam (16), the latter holding the actuating formation in a dead-locked condition at a first position and allowing free movement of the formation between locked and unlocked conditions at a second position to which it is resiliently urged. A motor driven dead-locking catch (28) is movable between an engaged position at which it coacts with a formation (26) of the operating cam with the latter at its first position for dead-locking without having to keep the motor driving the operating cam continuously energized, and a disengaged position leaving the operating cam free.

7 Claims, 2 Drawing Sheets

VEHICLE DOOR LOCKING SYSTEM

BACKGROUND OF THE INVENTION (1) Technical Field

This invention relates to locking systems for vehicle doors of the kind in which a central control unit is connected to the individual locks for electrical actuation of the latter whereby locking or unlocking of all the doors can be effected from a single control station actuated from within or outside the vehicle, hereinafter referred to as "central locking systems" and more specifically to the provision in the system of a dead-locking or super-locking facility by which the lock mechanism is selectively positively retained at the secure position so that it cannot be freed by use of any of the manual actuating means within or outside the vehicle.

(2) Description of the Prior Art

Vehicle door locking systems of the subject invention are increasingly desirable for improving the security of unattended vehicles so that a lock cannot readily be released by forcing a window or using a probe, hook or other tool to gain access to the interior door handles, sill release buttons or the like.

One example of a central locking system to which the invention is conveniently applicable is described in our GB Pat. No. 2176528.

The object of the invention is to provide a central locking system with a remotely controllable dead-locking facility which is economical to produce, compact so that it can be accommodated in known patterns of lock actuator units without increasing their bulk and/or without substantial redesign thereof, yet which is positive and reliable in use and of simple and durable construction.

SUMMARY OF THE INVENTION

According to the invention there is provided a power actuated unit for a central locking system including a lock actuating formation shiftable between locked and unlocked positions; a motor driven rotary operating cam formed to coact with the actuating formation for selective movement thereof in response to operation of a central control unit of the system in use, said cam being shaped to prevent displacement of the actuating formation from the locked position at a first position of the cam whereby the lock is held in a dead-locked condition but permit unrestricted movement of the lock actuating formation between locked and unlocked positions at a second position of said cam remote from the first position; and resilient means urging the operating cam to the second position; characterised in that said unit further includes a motor driven dead-locking catch shiftable between an engaged position positively retaining the operating cam at the first position to dead-lock the unit in use, and a disengaged position at which the cam is free to move to or from the first position.

Conveniently the cam is further moveable to a third position remote from the second position and on the opposite side thereof to the first position to effect positive displacement of the actuating formation to the unlocked position, and the resilient means may further urge the operating cam to the second position from both of the third and first positions.

The operating cam may be in the form of a rotary cam having a snail or other camming formation coacting with the actuating formation e.g. as described in our said GB Pat. No. 2176528.

Preferably the dead-locking catch is a dog projecting radially of a rotatably driven shaft, the envelope of revolution of the dog intersecting the path of movement of the operating cam to engage a cutout or notch therein when the cam is at the first position.

The dog or other dead-locking catch may be resiliently urged towards its disengaged position and a coacting face of the operating cam may be shaped to latch the dog or other dead-locking catch at its engaged position under resilient loading of the operating cam so that it is only released on powered shifting of the operating cam to disengage said face therefrom.

Conveniently, with the latter arrangement, there is also an angled or other camming face on the operating cam which urges or assists the dog or other dead-locking catch to its disengaged position on said powered shifting of the operating cam.

BRIEF DESCRIPTION OF THE DRAWINGS

The preferred embodiment of the invention is now more particularly described with reference to the accompanying drawings wherein FIGS. 1A, B and C are exploded perspective views of a power actuated locking unit showing different stages of its operation.

DESCRIPTION OF THE PREFERRED EMBODIMENT

Figure 1A:
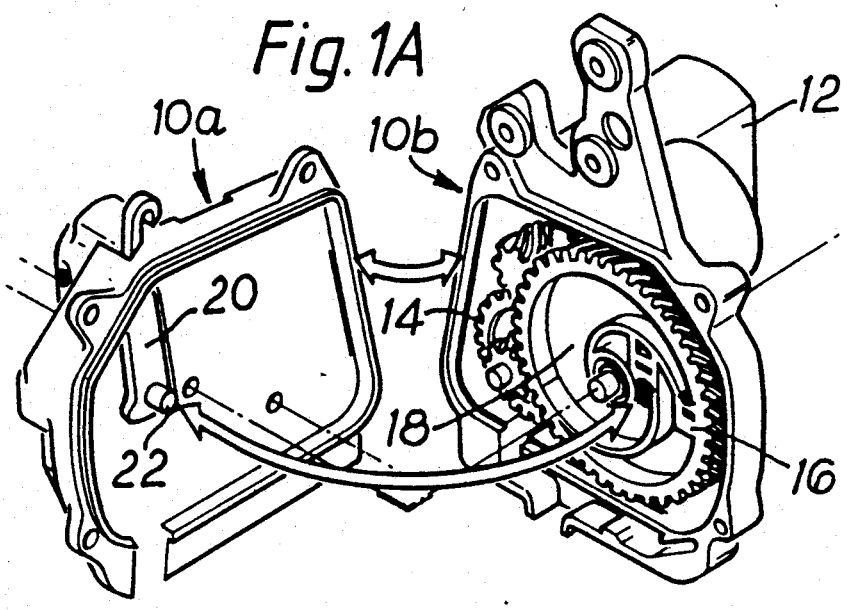

Referring firstly to FIG. 1 the unit shown is generally of the type described in GB Pat. No. 2176528 to which reference is made for further detail of its construction and operation and of a vehicle central locking system utilising a plurality of these units in conjunction with a central remote control station of the vehicle.

The unit includes a body or housing 10 formed in two parts 10*a*, 10*b* shown separated in FIG. 1. Part 10*b* mounts an actuating motor 12 and encloses a gear train 14 drivingly connecting the motor to an operating member in the form of a rotary cam 16 a front face of which is formed to provide a snail formation 18 in the form of a spiral profile hollow.

Figure 1B:
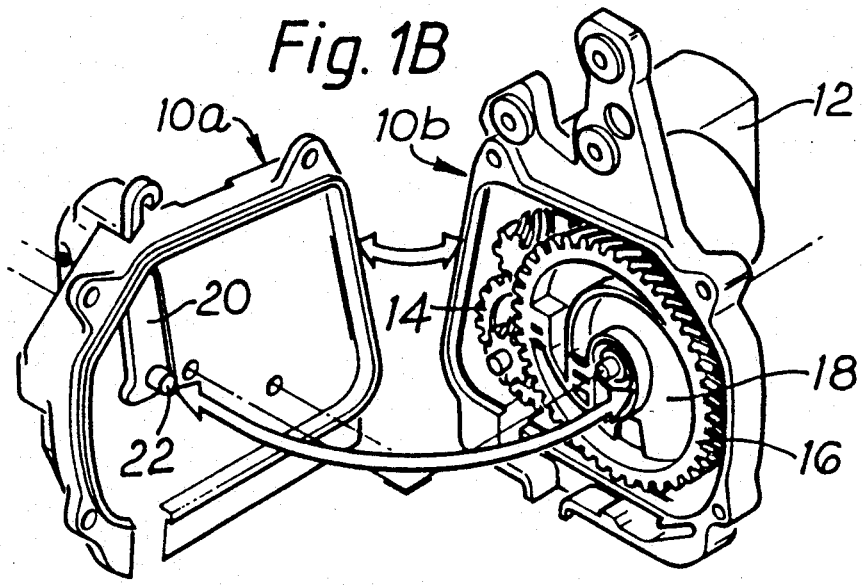
Figure 1C:
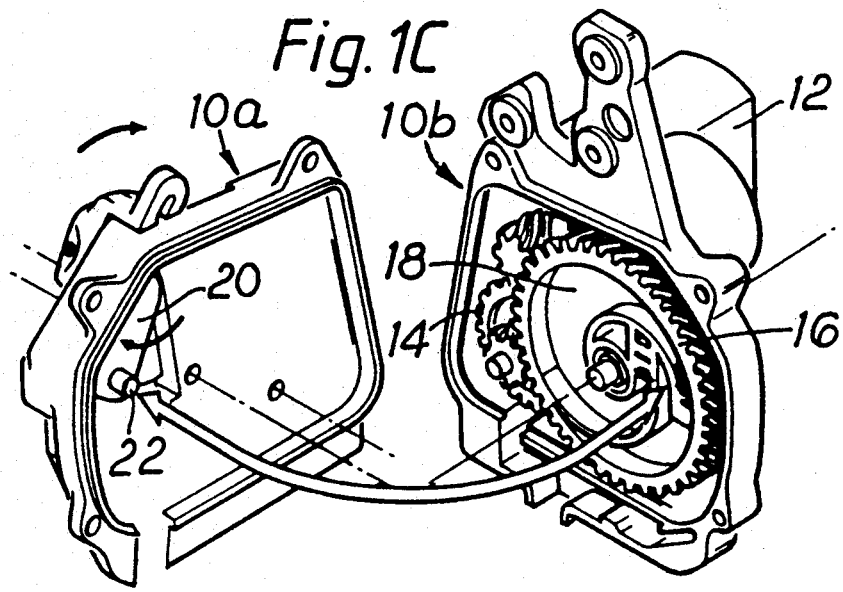

A lock actuating formation in the form of a lever 20 pivoted in body portion 10*a* is provided with a pin 22 which coacts with snail formation 18. On assembly the end of lever 20 remote from pin 22 which extends outside housing 10 will be linked to the lock mechanism of the associated door (not shown). Rotation of cam 16 in this example shifts lever 20 angularly to locked and unlocked positions for corresponding mechanical operation of the locking mechanism. Snail formation 18 is so profiled that at a first and extreme position of rotation pin 22 is trapped in a narrow radially outer end of formation 18 to drive lever 20 to its locked position as shown in FIG. 1C. At the middle of the range of rotation the cam is at a second position with pin 20 coacting with the radially wide portion of the snail formation 18 so that it is free to be manually shifted between locked and unlocked positions independently of operation of motor 12 e.g. by a sill button of the associated door. This position is shown in FIG. 18. At the other extreme of rotation with cam 16 at a third position, pin 22 is driven positively into the narrow and radially inner end of the formation to drive it to the unlocked position as shown in FIG. 1A.

Cam 16 is resiliently urged to the second (i.e. mid) position by a torsion return spring (not shown) within housing part 10*b*.

FIG. 2 shows a dead-locking catch arrangement of the unit. The rear face of rotary cam 16 (not visible in FIG. 1) is provided with a cutout or window 26 immediately adjacent to the toothed periphery of the cam.

A dead-locking catch in the form of a dog 28 coacts with window 26 in a manner to be described in greater detail below to positively secure cam 16 selectively at the first position so that the unit, and hence the associated latch mechanism, is dead-locked.

The acting part of dog 28 is of rectangular crosssection and projects radially from a shaft 30 of a small rotary dead-locking motor 32 mounted in housing part 10*b* behind the rim of cam 16, the axis of shaft 30 lying parallel to the plane of the cam rearface 24.

Figure 2A:
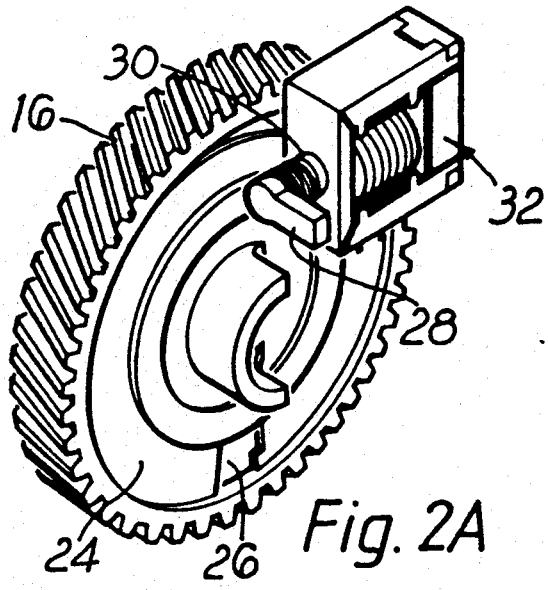
FIGS. 2A and B are perspective views of a cam type operating member of the unit and associated dead-locking catch in different positions of operation.
Figure 2B:
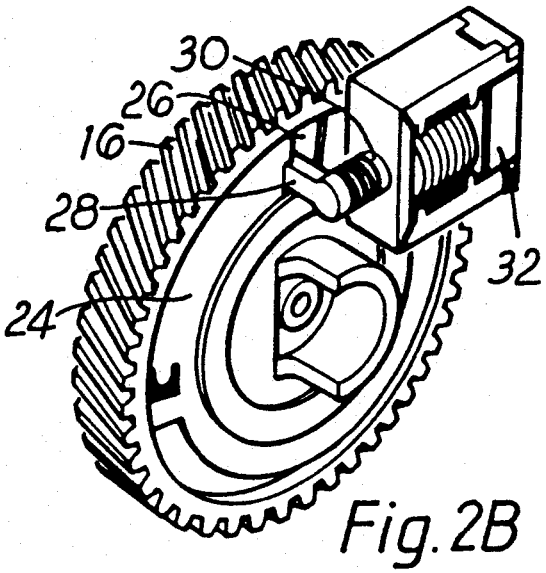

When motor 32 is powered it rotates shaft 30 and dog 28 through 180° from a disengaged position shown in FIG. 2A to an engaged position shown in FIG. 2B in which the acting distal end part of dog 28 enters the window 26.

Shaft 30 is provided with a return spring resiliently urging dog 28 to the FIG. 2A disengaged position.

Figure 3A:
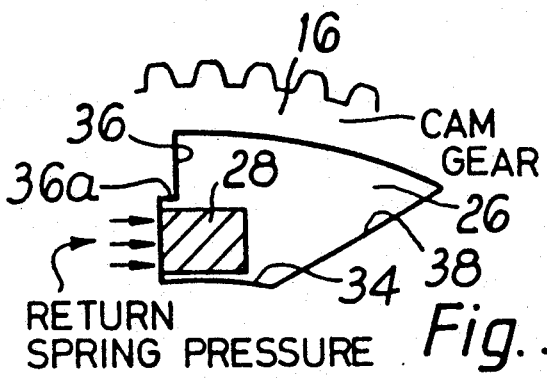
FIGS. 3A, B and C are detail diagrammatic views of the coaction between the catch and a formation of the operating cam.

Operation of motor 32 is phased with respect to operation of the main actuating motor 12 in use so that, when a dead-locking command is passed to the unit (and to other like equipped units on other doors of the vehicle) motor 12 will first operate to power the cam 16 to the first, i.e. dead-locked position (FIG. 1C) which will position window 26 to receive dog 28 i.e. rotating cam 16 anti-clockwise as viewed in FIG. 2. While power is still applied by motor 12, so holding cam 16 against the force of its return spring motor 32 is also operated to power dog 28 for rotation anti-clockwise as viewed in FIG. 2 from the disengaged position of FIG. 2A to the engaged position of FIG. 2B where the acting part of dog 28 is engaged in window 26, said rotation being against the force of the return spring on shaft 30. While power is maintained on motor 32 to urge the acting part of the dog against the lower i.e. radially inner edge 34 of window 28, power to actuating motor 12 is turned off and the action of the main return spring acting on cam 16 urges a trailing side edge 36 (i.e. trailing in the direction of unlocking rotation of cam 16) into abutment with a side face of dog 28 as shown in FIG. 3A. Edge 36 is notched to provide a downwardly directed, i.e. radially inwardly directed step 36*a* serving as a latch holding dog 28 against rotation from its engaged position under the action of its return spring. Power to motor 32 is now turned off and the mechanism of the unit and associated latch is mechanically positively held against movement from locked condition so preventing any actuation by the manual mechanism (e.g. door handles, sill buttons etc) of the associated door.

When the dead-locking condition is to be terminated an appropriate command to the central control unit will power motor 12 briefly in the locking direction i.e. again urging cam 16 anti-clockwise as viewed in FIG. 2. This movement frees dog 28 from the notched trailing side edge 36 of window 26 and causes its opposite side corner to be acted on by the leading side edge 38 of window 26. This latter edge is formed at an angle as shown in FIG. 3 so that it slopes radially outwardly in the leading direction.

Figure 3B:
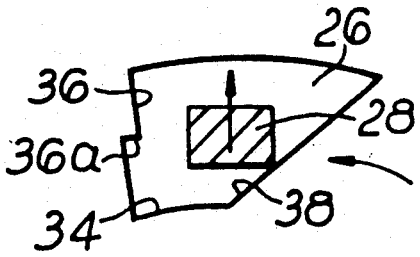
Figure 3C:
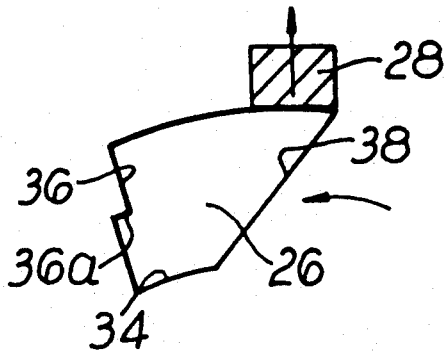

This sloping edge coacts with the corner of dog 28 as shown in FIG. 3*b* to "kick" it upwards (as viewed in the drawings) towards its disengaged position ensuring positive unlocking action coupled with the force exerted by the associated return spring on shaft 30, thus it swings clear of window 26 as in FIG. 3C to spring back to its disengaged position without any power having to be applied to the associated dead-locking motor 32. At the same time power to main motor 12 can be ceased, leaving the return spring of the cam 16 to restore it to the mid position of FIG. 1B leaving the mechanism free for operation by the manual actuating means (sill button etc) or, if positive unlocking is required by way of the central control unit, the appropriate command will operate motor 12 in the reverse direction to urge the cam to the unlocked position of FIG. 1A.

Operation in this manner simplifies the electrical connections required to the power actuated unit, three wires only are necessary, a common connection and an individual wire to each motor 12 and 32, electrical actuation and control being effected through appropriate control box switching contacts and motor protection being provided by thermistor devices or the like in known manner. Thus the motors may have protection by individual positive temperature coefficient temperature thermistors or use of a single common positive temperature coefficient thermistor for both motors is also contemplated.

It will be seen that the dead-locking catch unit consisting of motor 32, shaft 30, and dog 28 is extremely compact and simple to control and operate, thus its inclusion in existing designs of actuator unit is often possible without difficulty, without increase in the overall bulk and dimensions of the unit, and with minimum adaptation or redesign of the existing unit components, the only adaptation thereto being the shaping of the cam or other operating member to provide the coacting window or other formation for engagement by the dog or other dead-locking catch. As referred to above only one extra wire is needed together with one extra switching control so that this positive and reliable dead-locking feature can be incorporated in central locking systems of most designs of vehicle with little extra cost or difficulty.

I claim:

1. A power actuated unit for a central locking system including a lock actuating formation shiftable between locked and unlocked positions; a motor driven rotary operating cam having a camming formation formed to coact with the actuating formation for selective movement thereof in response to operation of a central control unit of the system in use, said cam being shaped to prevent displacement of the actuating formation from the locked position at a first position of the cam to hold said formation in a dead-locked condition but permit unrestricted movement of the lock actuating formation between the locked and unlocked positions at a second position of said cam remote from the first position; and resilient means urging the operating cam to the second position; characterised in that said unit further includes a dead-locking catch dog projecting radially of a motor driven rotatable shaft to be moved in an envelope of revolution intersecting the path of movement of the cam between an engaged condition at which the dog positively engages a formation of the cam to block movement of the latter when at the first position and a disengaged condition at which movement of the cam is unobstructed by said dog.

2. A unit as in claim 1 wherein said operating cam is further movable to a third position remote from the second position and on the opposite side thereof to the first position to effect positive displacement of said actuating formation to the unlocked position.

3. A unit as in claim 2 wherein said resilient means urges said cam to the second position from both the third and the first positions.

4. A unit as in claim 1 wherein said catch dog is resiliently urged towards its disengaged condition.

5. A unit as in claim 4 wherein the formation of said cam with which said catch dog engages in the engaged condition is shaped to latch the dog in the latter condition under resilient loading of said operating cam whereby said dog is only released by initiating powered shifting of said cam away from the first position.

6. A unit as in claim 5 wherein said cam includes an element which coacts with said dog on said powered shifting of said cam away from the first position to urge or assist displacement of said dog to its disengaged condition.

7. A unit as in claim 1 wherein the axis of said rotatable shaft from which the dog projects lies parallel to a radial face of the cam and the formation of the cam with which the dog engages is a cutout in said face.

* * * * *